United States Patent [19]

Knoll

[11] 4,199,710

[45] Apr. 22, 1980

[54] BALLAST CIRCUIT FOR HIGH INTENSITY DISCHARGE (HID) LAMPS

[75] Inventor: William C. Knoll, Turbotville, Pa.

[73] Assignee: GTE Sylvania Incorporated, Stamford, Conn.

[21] Appl. No.: 11,348

[22] Filed: Feb. 12, 1979

[51] Int. Cl.[2] ..... H05B 41/36

[52] U.S. Cl. ..... 315/205; 315/220; 315/DIG. 5; 315/DIG. 7

[58] Field of Search ..... 315/205, 209 R, 220, 315/255, DIG. 5, DIG. 7

[56] References Cited

U.S. PATENT DOCUMENTS

| | | | |
|---|---|---|---|
| 4,104,715 | 8/1978 | Lawson, Jr. | 315/DIG. 5 X |
| 4,109,307 | 8/1978 | Knoll | 315/205 X |
| 4,127,795 | 11/1978 | Knoll | 315/205 X |
| 4,127,893 | 11/1978 | Goepel | 331/113 A X |

*Primary Examiner*—Alfred E. Smith
*Assistant Examiner*—Charles F. Roberts
*Attorney, Agent, or Firm*—T. H. Buffton

[57] ABSTRACT

An electronic ballast circuit includes a directly driven high frequency inverter circuit with a series resonant output circuit coupled to a load circuit having a high intensity discharge (HID) lamp and to a drive circuit dependent upon current flow in the load circuit. A starting circuit for the high frequency inverter is coupled to a DC source and to a charge storage and isolating circuit and provides initial energization to the high frequency inverter circuit. Also, a lamp starting circuit initiates increased conductivity of the high frequency inverter circuit which causes development of energy sufficient to "fire" an HID lamp whereupon a disablement circuit essentially removes the lamp starting circuit from the operational circuitry.

15 Claims, 2 Drawing Figures

BALLAST CIRCUIT FOR HIGH INTENSITY DISCHARGE (HID) LAMPS

CROSS-REFERENCE TO ANOTHER APPLICATION

A pending application entitled "Direct Drive Ballast Circuit" bearing U.S. Ser. No. 908,044 filed May 22, 1978 and assigned to the Assignee of the present application includes an oscillator-type starting circuit for a high frequency inverter.

TECHNICAL FIELD

This invention relates to a ballast circuit for a high intensity discharge (HID) lamp and more particularly to a directly driven ballast circuit having a lamp starting and a lamp disablement circuit for utilizing a HID lamp.

BACKGROUND OF THE INVENTION

Generally, high intensity discharge (HID) lamps, such as mercury-arc or sodium vapor lamps for example, have a negative resistance impedance with a maintaining voltage which is a function of arc tube temperature. Thus, a ballast inductor is ordinarily employed to limit the current flow with respect to voltage of the lamp. However, the result is limited power available at the lamp and a relatively long warm-up period before the desired lighting is attained. Moreover, the inductor-type ballast circuitry is relatively inefficient, undesirably heavy and cumbersome, and subject to poor power regulation whenever line voltage fluctuations are encountered.

Attempts to overcome the above-mentioned disadvantages led to the development of electronic ballast circuits such as ringing-choke converters, push-pull inverters, and switching regulators. However, the ringing-choke converter tends to suffer from poor operating efficiency while the push-pull inverter is plagued with relatively poor regulation and an excess of magnetic components. Thus, the switching regulator type of circuit appears most suitable for ballast circuit applications.

Although switching regulator type circuity has been and still is employed in HID lamp apparatus, it has been found that presently known circuitry does leave something to be desired. More specifically, it has been found that the known switching regulator type circuitry for HID lamps is relatively expensive of components and assembly labor costs while leaving much to be desired with respect to efficiency and power consumption.

SUMMARY OF THE INVENTION

In one aspect of the present invention, an improved direct drive electronic ballast circuit for high intensity discharge (HID) lamps includes a high frequency inverter circuit coupled to a DC source shunted by a charge storage and isolating circuit and to a load circuit including an HID lamp. A starting circuit for the high frequency inverter couples the DC source to the high frequency inverter and becomes inactivated upon energization of the high frequency inverter. Also, a lamp starting or enablement circuit is activated by the starting circuit for the high frequency inverter and causes development of a potential sufficient to energize the HID lamp whereupon a disablement circuit is provided which, in response to conduction of the HID lamp, causes disablement of the lamp starting or enablement circuit.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
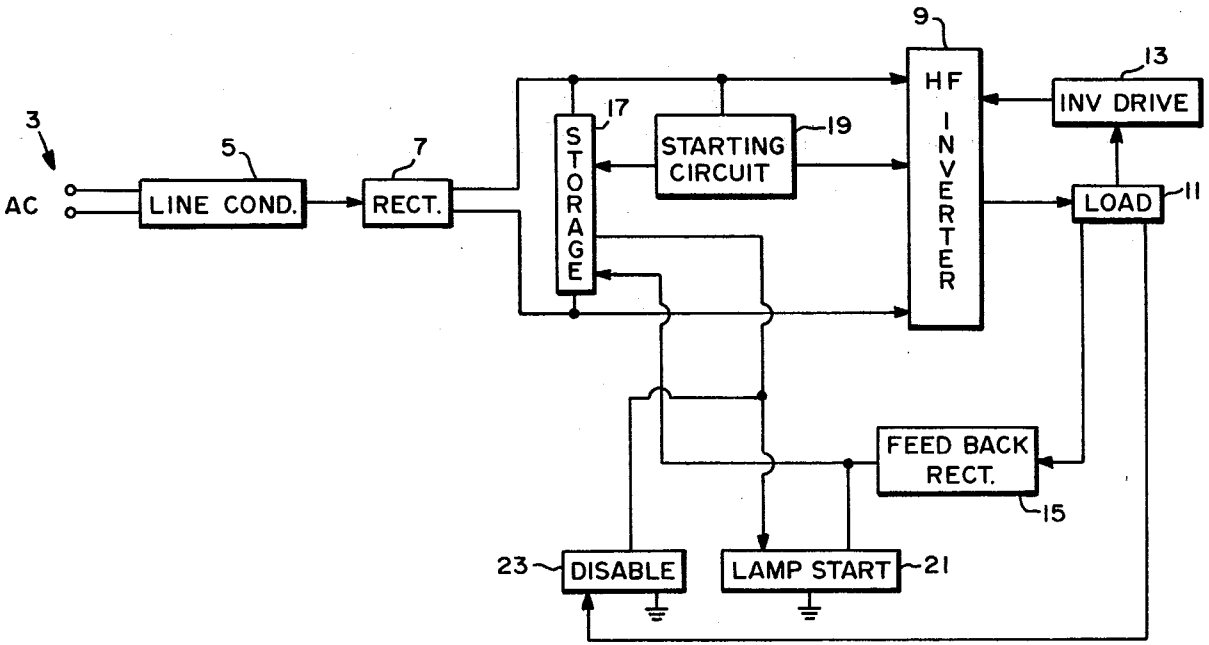
FIG. 1 is a diagrammatic illustration, in block form, of a preferred embodiment of a direct drive ballast circuit for a high intensity discharge (HID) lamp load.

Referring to the direct drive ballast circuit of the block diagram of FIG. 1, an AC source 3 is coupled by a line conditioner circuit 5 to a DC rectifier 7. The DC rectifier 7 is connected to a high frequency inverter circuit 9 which is, in turn, coupled to a load circuit 11. The load circuit 11 is coupled to an inverter drive circuit 13 for providing load-responsive drive potentials for the high frequency inverter circuit 9 and to a feedback rectifier circuit 15. The feedback rectifier circuit 15 provides load responsive energy to a charge storage and isolating circuit 17 shunting the DC rectifier 7.

A direct drive starting circuit 19 for the high frequency inverter circuit 9 is coupled thereto and to the DC rectifier 7 and to the charge storage and isolating circuit 17. Also, a HID lamp starting circuit 21 is coupled to the feedback rectifier circuit 15, the charge storage and isolating circuit 17, and to a potential reference level or circuit ground. Moreover, a disablement circuit 23 for the lamp starting circuit 21 is coupled to the load circuit 11 and shunts the lamp starting circuit 21.

Figure 2:
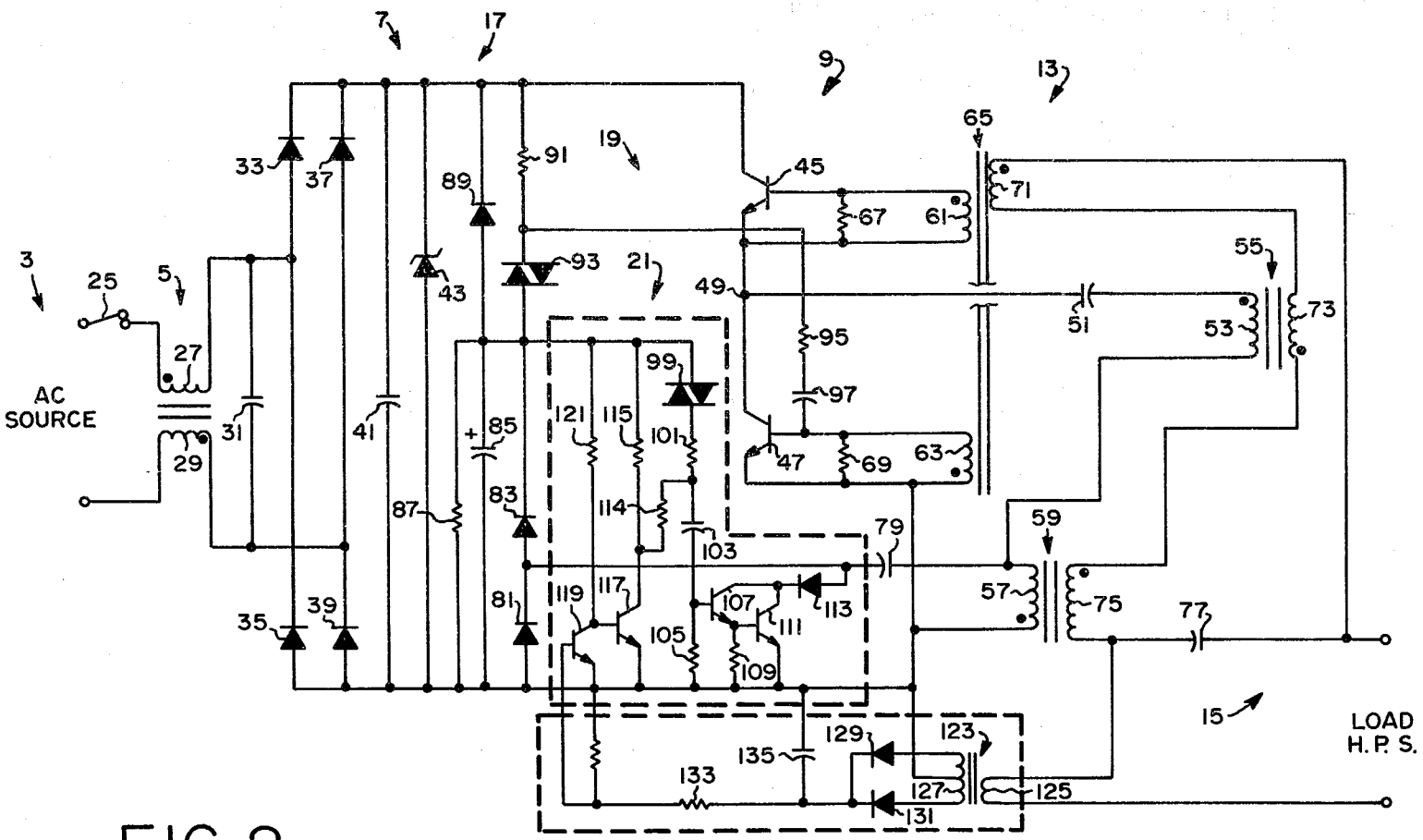
FIG. 2 is a schematic diagram of the preferred direct drive ballast circuit of FIG. 1.

In a more specific embodiment, FIG. 2 illustrates the direct drive ballast circuit of FIG. 1 and the numerals of FIG. 1 are applicable to the components of FIG. 2. Herein, the line conditioner circuit 5 includes an overload switch 25 coupled to one side of the AC source 3 and to one side of a first inductor 27. The other side of the AC source 3 is coupled to one side of a second inductor 29. Both inductors 25 and 27 are preferably affixed to the same core to maximize the mutual inductance therebetween and the opposite sides thereof are coupled to a capacitor 31.

The DC rectifier 7 is in the form of a fullwave bridge-type rectifier. The rectifier 7 has a pair of diodes 33 and 35 connected to one side of the line conditioner circuit 5 and a second pair of diodes 37 and 39 connected to the other side of the line conditioner 5. A filter capacitor 41 and a zener diode 43 are shunted across the series connected diodes 33 and 35 and the series connected diodes 37 and 39.

Connected to the DC rectifier 7 is the high frequency inverter circuit 9. The high frequency inverter circuit 9 includes a pair of series connected transistors 45 and 47 shunting the rectifier 7. The junction 49 of the series connected transistors 45 and 47 is coupled to a series resonant circuit including a series connected capacitor 51, a primary winding 53 of a second transformer 55 and a secondary winding 57 of a third transformer 59 of the feedback rectifier circuit 15. Each of the series connected transistors 45 and 47 has a base and emitter electrode coupled to a drive winding, 61 and 63 respectively, of a first transformer 65 with a damper resistor, 67 and 69 respectively, shunting each of the drive windings 61 and 63.

The high frequency inverter circuit 9 has a high frequency inverter drive circuit 13 coupled thereto. This high frequency inverter drive circuit 13 includes a primary winding 71 of the first transformer 65 whereby the secondary windings 61 and 63 and the transistors 45 and 47 are energized. Thus, energization of the high frequency inverter circuit 9 is dependent upon current flow through the inverter drive circuit 13 which is, in turn, coupled to and dependent upon current flow in the load circuit 11.

The load circuit 11 includes a secondary winding 73 of the second transformer 55 in series connection with the primary winding 75 of the third transformer 59 of the feedback rectifier circuit 15, a load capacitor 77 and a high intensity discharge (HID) lamp (not shown). Moreover, the secondary winding 73 is also series connected to the primary winding 71 of the high frequency inverter drive circuit 13.

As mentioned above, the feedback rectifier circuit 15, in the form of a voltage doubler, includes the secondary winding 57 of the third transformer 59. This secondary winding 57 is coupled by a capacitor 79 to the junction of a pair of series connected diodes 81 and 83 forming a voltage doubler circuit. One of the series connected diodes 83 is connected to the junction of a series connected capacitor 85 shunted by a resistor 87 and an isolating diode 89 of the charge storage and isolating circuit 17.

A direct drive starting circuit 19 for the high frequency inverter circuit 9 includes a resistor 91 and a diac 98 series connected to the DC rectifier 7 and to the junction of the capacitor 85 and diode 89 of the charge storage and isolating circuit 17. The junction of the series connected resistor 91 and diac 93 is connected by a series coupled resistor 95 and capacitor 97 to the base of the transistor 47 of the high frequency inverter circuit 9.

Further, a lamp starting circuit 21 in the form of a relaxation oscillator includes a diac 99 coupled to the junction of the series connected capacitor 85 and diode 89 of the charge storage and isolating circuit 17 and to the diac 93 of the direct drive starting circuit 19. The diac 99 is connected to circuit ground by a series connected first resistor 101, capacitor 103 and second resistor 105. The junction of the series connected capacitor 103 and second resistor 105 is connected to the base of a first transistor 107 having an emitter coupled by a resistor 109 to circuit ground and directly coupled to the base of a second transistor 111 with a grounded emitter. The collector of the first transistor 107 is connected to the collector of the second transistor 111 and via a diode 113 to the feedback rectifier circuit 15. Also, the junction of the first resistor 101 and capacitor 103 is connected to a resistor 114 coupled to the junction of a resistor 115 connected to the diac 99 and a transistor 117 connected to circuit ground. Another transistor 119 has a collector electrode connected to the base of the transistor 117 and via a resistor 121 to the diac 99. The emitter of the transistor 119 is connected to a potential reference level such as circuit ground.

Additionally, a disablement circuit 23 for the lamp starting circuit 21 includes a fourth transformer 123 having a primary winding 125 coupled to the capacitor 77 and the HID lamp (not shown) of the load circuit 15. The secondary winding 127 of the fourth transformer 123 has a center tap coupled to a reference potential and opposite ends each connected to a diode, 129 and 131 respectively. The diodes 129 and 131 are tied in common to a resistor 133 and via a filter capacitor 135 to the potential reference level. The resistor 133 is coupled to the base of the transistor 119 and via a resistor 121 to the potential reference level.

As to operation, a potential from the AC source 3 is filtered by the line conditioner circuit 5 which serves as both a transient and a radio frequency interference (RFI) filter. The resultant filtered AC signal, devoid of undesired transient spikes and RFI signals is applied to the full-wave bridge-type rectifier circuit 7. This rectifier circuit 7 provides a pulsating DC potential at a frequency of about 120 Hz. Moreover, this pulsating DC potential is altered, in a manner to be explained hereinafter, to provide a relatively steady-state DC potential which is applied to the high frequency inverter circuit 9.

The high frequency inverter circuit 9 is in the form of a chopper with a pair of substantially similar transistors 45 and 47 operable in a push-pull mode. The oscillator or inverter 9 has a series resonant output circuit which includes the capacitor 51 and primary winding 53 of the second transformer 55. This series resonant circuit has a resonant frequency of about 20 KHz, which is well above the audio range and therefore removed from the frequency ranges which might be deleterious or annoying to a consumer. As expected, this series resonant output circuit provides a low impedance path to current flow therethrough and any increase in current flow is accompanied by increased current flow in the secondary windings 73 of the second transformer 55 as well as increased current flow in the primary winding 71 of the first transformer 65, the primary winding 75 of the third transformer 59, and the primary winding 125 of the fourth transformer 123.

Importantly, increased current flow in the secondary winding 73 of the second transformer 55, or the load circuit 11, is accompanied by increased current flow in the primary winding 71 of the transformer 65 or in the inverter drive circuit 13. Thus, the high frequency inverter circuit 9 not only derives drive potential from the series connected resonant circuit of capacitor 51 and inductor winding 53 but also in accordance with the magnitude of current flowing in the load circuit 11.

Also, increased current flow in the resonant circuit including the winding 53 of the second transformer 55 is accompanied by an increased current flow in the inductive windings 75 and 57 of the third transformer 59. This increased current flow is rectified by the voltage doubler circuit, including diodes 81 and 83, and applied to the charge storage capacitor 85. The charge storage capacitor 85 stores this received energy so long as the pulsating DC potential of the DC rectifier 7 remains above a given reference level. However, when the pulsating DC potential decreases below the given reference level, the capacitor provides energy thereto via the isolating diode 89. Thus, a relatively steadystate DC potential is applied to the high frequency inverter circuit 9.

Further, it has been found that the switching capability of the transistors of a high frequency inverter circuit is enhanced when driven directly from a transformer rather than through a complex base biasing arrangement. However, it has also been found that the high frequency inverter circuit 9 would not self-start when a direct drive system was employed. Also, it was found that minimizing the component count of the starting circuit would reduce costs, facilitate mechanized assembly and increase reliability of the circuit.

As to operation of the starting circuit 19 for the high frequency inverter 9, there is no initial energy feedback to the charge storage capacitor 85 prior to operation of the high frequency inverter circuit 9. However, energy from the AC source 3 causes development of a relatively high potential at the capacitor 41 which, in turn, causes development of a relatively high potential at the capacitor 97 of the inverter starting circuit 19 via the resistors 91 and 95 and the winding 63 of the first transformer 65. Moreover, the high frequency inverter 9 has not yet become operable.

When the charge appearing at the capacitor 97 is of an amount which exceeds the breakover voltage of the diac 93, the capacitor 97 discharges through the diac 93, the capacitor 85, and the winding 63 of the first transformer 65. The winding 63 transmits the discharge current to the emitter-base junction of the transistor 47 of the high frequency inverter circuit 9 biasing the transistor on and starting the oscillator of the high frequency inverter circuit 9. Upon starting, the high frequency inverter circuit 9 charges the storage capacitor 85. This charge on the storage capacitor 85 is sufficient to prevent the voltage across the isolating diode 89 from reaching a value sufficient to effect breakover of the diac 99. As a result, the starting circuit 19 is, for all practical purposes, removed from the operational circuitry once having accomplished the task of starting the high frequency inverter circuit 9.

Additionally, it is well known that high intensity discharge (HID) lamps require a starting potential of increased magnitude as compared with the voltages necessary to maintain the lamp operational. Thus, it becomes necessary to provide a lamp starting potential, which may be as much as 2.5 KV, whenever HID lamps are employed.

To this end, an increase in the potential appearing at the storage capacitor 85 causes breakover of the diac 99 whereupon a pulse potential at the capacitor 103 is applied to the base of the transistor 107 causing conductivity thereof. The transistor 107, in turn, causes conductivity of the transistor 111 and the diode 113 whereupon the feedback rectifier circuit 15 is, for all practical purposes, short-circuited and the high frequency inverter circuit 9 is driven harder. As the high frequency inverter 9 is driven harder, current flow increases in the load circuit 11 and the secondary winding 73 of the second transformer 55, the winding 75 of the third transformer 59 and the capacitor 77 form a series resonant circuit. Thereupon, a charge is developed at the capacitor 77 in an amount sufficient to "fire" or initiate conduction of a HID lamp in the load circuit 11.

Further, firing of the HID lamp (not shown) causes an increased current flow through the winding 125 of the fourth transformer 123. This increased current flow is coupled via the winding 127 to the diodes 129 and 131 to provide a rectified potential which is filtered and applied to and effects conduction of the transistor 119. In turn, transistor 117 is rendered non-conductive which, in essence, removes the lamp starting circuit 21 from the operational circuitry. Thus, the lamp starting circuit 21 is operational to effect "firing" of the HID lamp and essentially disconnected from the circuitry once the HID lamp reaches a conductive state.

While there has been shown and described what is at present considered the preferred embodiment of the invention, it will be obvious to those skilled in the art that various changes and modifications may be made therein without departing from the invention as defined by the appended claims.

INDUSTRIAL APPLICABILITY

Thus, there has been provided a unique direct drive electronic ballast circuit for HID lamps. The circuitry has an enhanced starting capability and the ballast starting circuitry is essentially rendered inoperative once the high frequency inverter circuity becomes operable. Also, a unique lamp starting circuit is provided wherein the necessary high voltages required to "fire" an HID lamp are derived from the high frequency inverter apparatus. Additionally, a disablement circuit is provided whereby the lamp starting circuit is essentially removed from the active operational circuitry upon energization of the HID lamp. Moreover, the circuitry is load dependent whereupon alterations in loading conditions are immediately reflected back into and control the operation of the direct drive ballast circuitry.

I claim:

1. In a direct drive ballast circuit for a high intensity discharge (HID) lamp having a high frequency inverter circuit coupled to a DC source and to a HID lamp load circuit; a drive circuit coupling the HID lamp load circuit to the high frequency inverter circuit; a charge storage and isolating circuit shunting the DC source; a high frequency inverter starting circuit coupled to the high frequency inverter circuit and to the DC source, the charge storage and isolating circuit, and to the high frequency inverter circuit; and a feedback rectifier circuit coupled to the HID lamp load circuit and to the charge storage and isolating circuit, the improvement comprising a lamp starting circuit coupled to said charge storage and isolating circuit and to said feedback rectifier circuit and a lamp disablement circuit coupled to said HID lamp load circuit and to said lamp starting circuit whereby conductivity in said HID lamp load circuit energizes the lamp disablement circuit which disables the lamp starting circuit.

2. The improvement of claim 1 including a line conditioning circuit coupled to said DC source and to an AC source.

3. The improvement of claim 1 wherein said lamp starting circuit is in the form of an oscillator circuit coupled to said charge storage and isolating circuit and to said feedback rectifier circuit.

4. The improvement of claim 1 wherein said lamp starting circuit is in the form of a direct drive oscillator circuit having a diac coupled to said charge storage and isolating circuit and to a first switching circuit means shunting said feedback rectifier circuit whereby energization of said oscillator circuit causes said first switching circuit means to disable said feedback rectifier circuit whereby said high frequency inverter provides energy to said load circuit in an amount sufficient to effect conductivity of an HID lamp.

5. The improvement of claim 1 wherein said lamp disablement circuit includes a rectifier means coupled to said HID lamp load circuit and via a filter and a second switching means to said lamp starting circuit.

6. The improvement of claim 1 wherein said HID lamp load circuit includes a series connected inductance and capacitor providing a series resonant circuit coupled to an HID lamp.

7. The improvement of claim 1 wherein said feedback rectifier circuit includes a transformer winding in series connection with a series resonant circuit and an HID lamp of said HID lamp load circuit.

8. The improvement of claim 1 wherein said feedback rectifier circuit is in the form of a dual diode rectifier coupled to said HID lamp load circuit and by a second switching means to said lamp starting circuit.

9. In a direct drive ballast circuit for a high intensity discharge (HID) lamp having a high frequency inverter circuit coupled to a DC source, a charge storage and isolating circuit shunting the DC source, a high frequency inverter starting circuit coupled to the DC source and to the charge storage and isolating circuit and to the high frequency inverter circuit, the improvement comprising an HID lamp load circuit coupled to said high frequency inverter circuit, a high frequency inverter drive circuit coupling said HID lamp load circuit to said high frequency inverter circuit, a feedback rectifier circuit coupling said HID lamp load circuit to said charge storage and isolating circuit, a lamp starting circuit coupled to said charge storage and isolating circuit and to said feedback rectifier circuit and a lamp disablement circuit coupled to said HID lamp load circuit and to said lamp starting circuit whereby said lamp starting circuit alters said feedback rectifier circuit in a manner to cause said high frequency inverter circuit to energize said HID lamp load circuit in an amount sufficient to energize a HID lamp and energization of said HID lamp causes said lamp disablement circuit to disable said lamp starting circuit.

10. The improvement of claim 9 wherein said HID lamp load circuit includes a series resonant circuit in series connection with an HID lamp.

11. The improvement of claim 9 wherein said feedback rectifier circuit includes a voltage doubler type rectifier connecting said HID lamp load circuit to said charge storage and isolating circuit.

12. The improvement of claim 9 wherein said lamp starting circuit is in the form of an oscillator circuit.

13. The improvement of claim 9 wherein said lamp starting circuit includes an oscillator circuit in series connection with a first switching circuit shunting said feedback rectifier circuit.

14. The improvement of claim 9 wherein said lamp starting circuit includes an oscillator circuit having a series connected diac and capacitor coupled to a first switching circuit shunting said feedback rectifier circuit.

15. The improvement of claim 9 wherein said lamp disablement includes a rectifier, filter and second switching circuit coupled to said load circuit and to said lamp starting circuit.

* * * * *